United States Patent [19]

Mizunuma

[11] Patent Number: 4,968,261

[45] Date of Patent: Nov. 6, 1990

[54] ELECTRICAL CONNECTOR

[75] Inventor: Yasuyuki Mizunuma, Kanuma, Japan

[73] Assignee: Daiichi Denshi Kogyo Kabushiki Kaisha, Tokyo, Japan

[21] Appl. No.: 473,889

[22] Filed: Feb. 2, 1990

[30] Foreign Application Priority Data

Feb. 15, 1989 [JP] Japan ..... 1-16476

[51] Int. Cl.[5] ..... H01R 13/652

[52] U.S. Cl. ..... 439/108; 439/607

[58] Field of Search ..... 439/92, 108, 607-610

*Primary Examiner*—Gary F. Paumen

*Attorney, Agent, or Firm*—Silverman, Cass & Singer, Ltd.

[57] ABSTRACT

An electrical connector having a noise-proof metal shell includes a particular construction of the metal shell capable of maintaining reliable connecting condition between the metal shell and grounding elements without causing any faulty connection therebetween even if the connector is used under a condition prone to vibration or suffered from shrinkage occuring in an insulating block of the connector due to aging.

9 Claims, 4 Drawing Sheets

ELECTRICAL CONNECTOR

BACKGROUND OF THE INVENTION

This invention relates to an electrical connector having a noise-proof metal shell, and more particularly to an electrical connector having an improved connection between a noise-proof metal shell and a grounding element to be connected to a ground.

A connector having at contacts 1 a metal shell 2 for preventing inductive interference as shown in FIG. 1 has been used as a so-called "interface connector" for connecting a printed circuit board and an input circuit in a so-called office automation appliance such as a personal computer.

Such a connector generally includes the desired number of the contacts 1 having L-shaped contact tails 1*a* and fixed in an L-shaped insulating block 3, and hexagonal studs 4 threadedly engaging connecting pieces 5*a* of L-shaped grounding elements 5 to embrace a mounting flange 2*a* of the metal shell 2 and connecting pieces 3*a* of the insulating block 3. In using the connector, it is fixed to a printed circuit board 6 in the following manner.

First, the contact tails 1*a* of the contacts 1 are inserted into soldering apertures 7 formed in a circuited pattern 6*a* of the printed circuit board 6 as shown in FIG. 1. Thereafter, fixing pieces 5*b* of the grounding elements 5 and the printed circuit board 6 together with a fixing piece 3*b* of the insulating block 3 are clamped by means of set screws 8 and nuts 9 so that these members are embraced by the nuts 9 and heads of the set screws. In this manner, the metal shell 2 is connected to the ground pattern 6*b* of the printed circuit board 6 for use.

Moreover, each hexagonal stud 4 is often formed with an internal thread (not shown) in an end which is not connected to the grounding element 5. The internal threads of the hexagonal studs 4 are adapted to threadedly engage screw thread members (not shown) rotatably provided on a mating connector (not shown) so that the hexagonal studs 4 are frequently used as part of locking means for preventing dislodgment of these connectors.

With this connector of the prior art, the metal shell 2 is readily removed from the connector by loosening the hexagonal studs 4 so that it is very convenient for maintenance, inspection and cleaning for the contacts 1. In case of being used under a condition prone to vibration, however, there is a risk of the hexagonal studs 4 being loosened during use. Moreover, a plastic material of the insulating block 3 may shrink due to aging to loosen the tightness of the hexagonal studs 4. Therefore, connection between the metal shell 2 and the grounding elements 5 for grounding the metal shell 2 may become faulty with the result that the noise preventing effect is reduced and the reliability in operation is lost.

Instead of the locking means of the threaded engaging hexagonal studs 4 as shown in FIGS. 1 and 2, another means may be used for preventing dislodgment of the connector. In this case, a metal shell of a connector is provided with locking members formed with openings in which hook pieces fixed to a mating connector are latched. In this case, the locking members may be formed by extending the mounting flange 2*a* outwardly of hexagonal studs 4 or by providing an additional member constituting the locking members. In any case, such a construction will provide a longer connector which does not fulfill the requirement of miniaturization of connectors with the recent tendency of electronic appliances to be miniaturized.

In case of using the hexagonal studs 4, moreover, arranging and tightening steps of the screw members are required which make difficult automatic assembling of connectors and do not meet the requirement to reduce the number of parts.

SUMMARY OF THE INVENTION

It is an object of the invention to provide an electrical connector having a connecting construction which does not cause any faulty connection between a metal shell and grounding elements even under a circumstance likely to undergo vibrations and even if the insulating block shrinks by aging.

It is another object of the invention to provide an improved connecting construction between a metal shell and grounding elements of an electrical connector to realize the miniaturization of the connector having locking means using plate-shaped locking arms for preventing dislodgment between the connector and a mating connector.

It is a further object of the invention to provide an improved connecting construction between a metal shell and grounding elements of an electrical connector which does not require arranging and tightening steps for screws and is capable of automatic assembly.

In order to accomplish these objects, in an electrical connector including a metal shell for shielding contacts and grounding elements to be connected to the metal shell through a portion of an insulating block for fixing the contacts, according to the invention the connector comprises connecting tongues formed on the metal shell, and connecting pieces provided on the grounding elements and formed with slits, each of the connecting tongues being inserted into the, slit of each of the grounding elements and connected thereto, the insulating block being formed with through-apertures with clearances with the connecting tongues and said connecting pieces of the grounding elements when they are inserted into the through-apertures of the insulating block, thereby connecting the metal shell and the grounding elements by the connection between the connecting tongues and the connecting pieces of the grounding elements inserted in the through-apertures of the insulating block.

With the above arrangement according to the invention, as the through-apertures of the insulating block have sufficient clearances relative to the connecting pieces of the grounding elements and the connecting tongues of the metal shell connected in the through-apertures, the connections between the metal shell and the grounding elements are not detrimentally affected by contraction or expansion of the insulating block due to aging even if it would occur. Therefore, no faulty connection is caused between the metal shell and grounding elements.

Moreover, in instances where the metal shell includes locking arms as locking means for preventing dislodgment between the connector and a mating connector, such locking arms can be formed integrally with the metal shell together with the connecting tongues by pressforming, with resulting lower manufacturing cost. Furthermore, the connecting tongues and the locking arms extending in opposite directions can be provided at the same level on the metal shell, so that the locking means of the locking arms contribute to the reliable connection between the connector and a mating connector without increasing the length of the connector.

In manufacturing the connector according to the invention, all that, is required for connecting the metal shell and grounding element is simple press-fitting without requiring any steps of arranging and screwing set screws. Therefore, automatic assembling of the connectors according to the invention can be easily carried out.

The invention will be more fully understood by referring to the following detailed specification and claims taken in connection with the appended drawings.

DETAILED DESCRIPTION OF THE PREFERRED EMBODIMENTS

Figure 1:
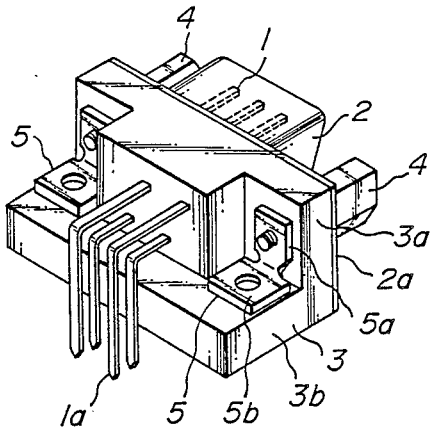
FIG 1 PRIOR ART
FIG. 1 is a perspective view of a connector of the prior art viewed from a rear side of the connector.
Figure 2:
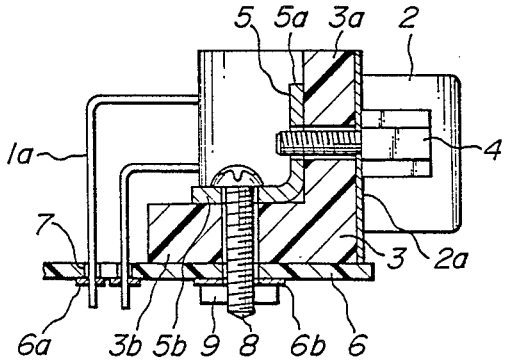
FIG 2 PRIOR ART
FIG. 2 is a sectional view of the connector of the prior art shown in FIG. 1.
Figure 3:
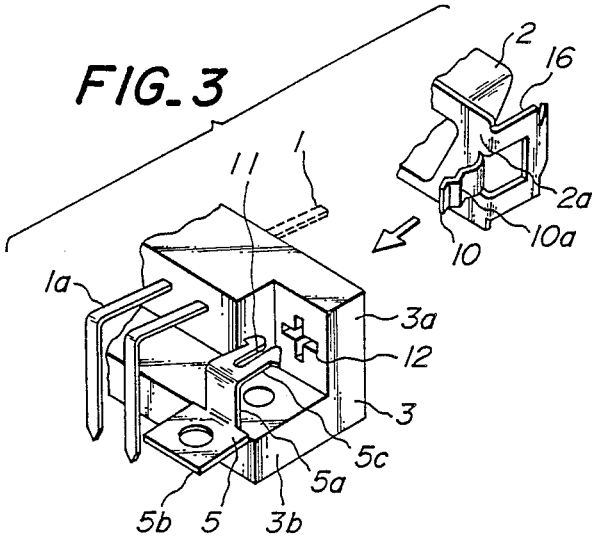
FIGS. 3 and 4 are a perspective view and a partial sectional view for explaining a connector of one embodiment according to the invention.
Figure 4:
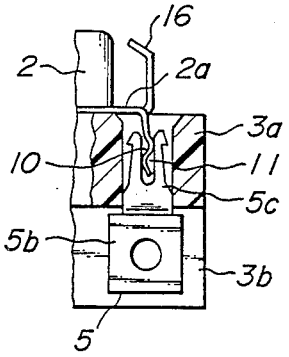

FIG. 3 is a partial exploded perspective view illustrating one embodiment of a connector according to the invention and FIG. 4 is a sectional view of a part of the connector shown in FIG. 3 under a connected condition, wherein like components have been designated by the same reference numerals as those in FIGS. 1 and 2.

Referring to FIGS. 3 and 4, the connector includes contacts 1 having contact tails la and fixed to an insulating block 3 and a metal shell 2 having a mounting flange 2*a*. The mounting flange 2*a* is formed with connecting tongues 10 which are formed, for example, by slitting the mounting flange 2*a* and raising and turning the slit portions surrounded by slits in an inserting direction of the connector into a mating connector. In this case, the mounting flange 2*a* has locking arms 16 as locking means for preventing dislodgment between the connector and a mating connector. Each of the connecting tongues 10 includes a corrugated portion 10*a*. Each of the grounding elements 5 comprises a connecting piece 5*a*, a fixing piece 5*b* and a connecting piece 5*c* which is in parallel with the fixing piece 5*b* and lies in a plane rotated through 90° relative to a surface of the connecting tongue 10.

The connecting piece 5*c* is formed with a U-shaped slit 11 extending in an inserting direction (shown by an arrow in the drawing) of the connecting tongue 10 and having a length and a width required for positive connection between the connecting piece 5*c* and the connecting tongue 10. The width of the U-shaped slit 11 is generally less than distances between crests of waves of the corrugated portion 10*a* of the connecting tongue 10.

In an actual example, a grounding element 5 included a connecting piece 5*c* made of phosphor bronze and having a thickness of about 0.7 mm and a width of about 3 mm. The connecting piece 5*c* was formed with a U-shaped slit 11 having a width of about 0.6 mm. On the other hand, a mounting flange 2*a* having connecting tongues 10 was made of a steel plate having a thickness of 0.5 mm. In this case, a good connection was obtained when distances between crests of waves of corrugated portions 10*a* of the mounting flange 2*a* were about 0.85 mm. The grounding elements 5 and the connecting tongues 10 were plated with nickel.

Referring to FIGS. 3 and 4, the insulating block 3 is formed with cross-shaped through-apertures 12 each consisting of a horizontal aperture capable of receiving therein the connecting piece 5*c* of the grounding element 5 settled on a fixing piece 3*b* of the insulating block 3 with sufficient clearances, and a vertical aperture capable of receiving therein the connecting tongue 10 of the metal shell 2 with sufficient clearances. A thickness of the connecting pieces 3*a* of the insulating block 3 is selected so as not permit the connecting pieces 5*c* inserted in the cross-shaped through-apertures 12 to extend beyond a surface of the insulating block 3 on which the metal shell 2 is mounted. The connector is assembled in the following manner and shaped or transported.

First, the connecting pieces 5*c* of the grounding elements 5 are inserted into the horizontal apertures of the cross-shaped through-apertures 12 formed in the connecting pieces 3*a* of the insulating block 3 as shown in FIG. 4. Then, the connecting tongues 10 of the metal shell 2 are inserted into the vertical apertures of the cross-shaped through-apertures until the surface of the mounting flange 2*a* of the metal shell 2 abuts against a surface of the connecting pieces 3*a* of the insulating U-shaped slits 11 of the connecting pieces 5*c* positioned in a plane rotated through 90° relative to the connecting tongues 10 in a manner forcing the U-shaped slits 11 of the connecting pieces 5*c* to expand against the elasticity of the connecting pieces 5*c*.

Therefore, the connecting tongues 10 are in intimate contact with the connecting pieces 5*c* with the aid of the crests of the corrugated portions 10*a* of the connecting tongues 10. At the same time, moreover, elastic forces caused thereat securely hold the connecting tongues 10 to prevent their dislodgment therefrom. Further, the cross-shaped apertures 12 have sufficient clearances with the connecting tongues 10 and the connecting pieces 5*c* so as not to permit at least tip ends of these members to contact inner surfaces of the cross-shaped through-apertures 12. Therefore, even if the insulating block 3 contracts, the connection is not detrimentally affected by such a contraction of the block 3.

Accordingly, a reliable connection is obtained between the metal shell 2 and the grounding elements 5 without any wobbling of these members. Such an unstable connection is caused in the connector of the prior art by movement of the mounting flange 2*a* allowed by play between the screw threads of the hexagonal studs 4 and the threaded apertures of the mounting flange 2*a* resulting from loosening of the tightened hexagonal studs 4 caused by vibration and shrinkage of the insulating block 3 by aging.

Figure 8:
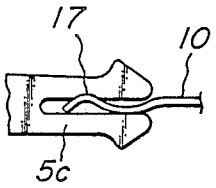

In a modification of the above embodiment, a side of the U-shaped slit 11 of the connecting piece 5*c* of each of the grounding elements 5 is formed with a recess 17 to be fitted with one wave of the corrugated portion 10*a* of the connecting tongue 10 for the purpose of increasing the holding force of the metal shell 2 as shown in FIG. 8.

Figure 5:
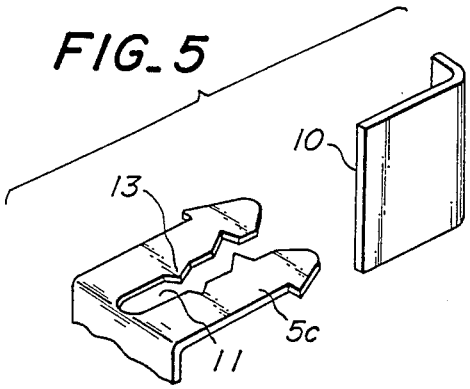
FIGS. 5, 6*a*, 6*b*, 7 and 8 are views for explaining other embodiments of the invention, respectively.

Moreover, as shown in FIG. 5, sides of the U-shaped slit 11 may be formed with alternate recesses and protrusions as 13 to form an undulate slit corresponding to the corrugations of the portion 10*a* of the connecting tongue 10. This modification has an advantage in manufacture in that the connecting tongues 10 and the grounding elements 5 are made only by punching by means of a press without requiring a step of forming corrugated portions 10*a* of the connecting tongue 10.

In this embodiment, furthermore, as shown in FIG. 4, the grounding element may be tapered so that a bottom of the connecting piece 5c thereof is in contact with inner surfaces of the through-aperture 12 to cause a slight restraining force for preventing displacement of the grounding element 5. Such a displacement of the grounding element 5 will cause misalignment of apertures of the fixing pieces 5b of the grounding element 5 and the fixing piece 3b of the insulating block 3 for passing a set screw therethrough to make difficult the assembling the connector.

Figure 6A:
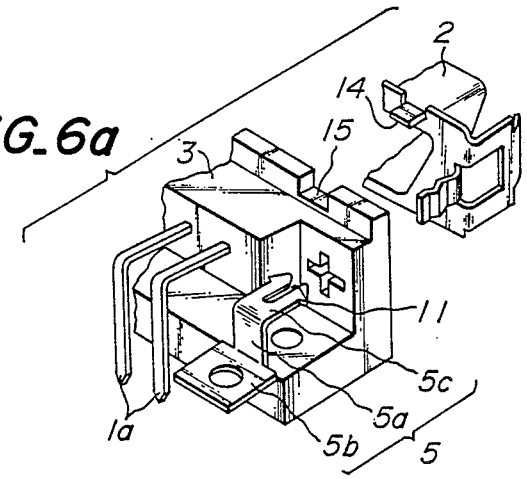
Figure 6B:
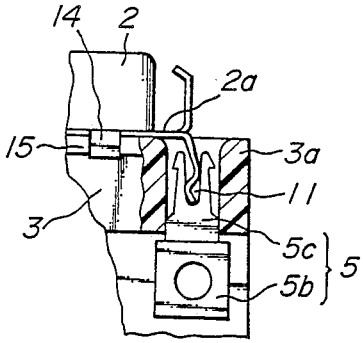
Figure 7:
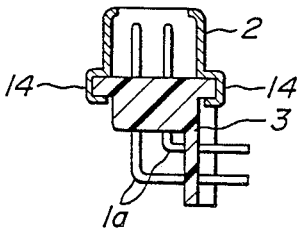

In the connector according to the invention, moreover, the metal shell 2 is fixed to the insulating block 3 with unobjectionable forces by means of fitting of the corrugated portions 10a of the connecting pieces 10 with the U-shaped slits 11 of the grounding elements 5. If it is desirable to more dynamically reinforce, a fixing construction may be employed as shown in FIGS. 6a and 6b or 7. The metal shell 2 is formed with tabs 14 and the insulating block 3 is formed with notches 15 corresponding to the tabs 14 as shown in FIG. 6a so that the metal shell 2 is more firmly fixed to the insulating block 3 by fitting the tabs 14 in the notches 15 and bending the tabs along the block 3 as shown in the partial sectional view of FIG. 6b. As an alternative, the metal shell 2 is formed with tabs 14 on all or part of its circumference so that the metal shell 2 is more firmly fixed to the insulating block 3 by bending the tabs 14 onto side edges of the block 3 as shown in FIG. 7.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In an electrical connector including an insulating block and a metal shell for shielding contacts and grounding elements to be connected to the metal shell through a portion of said insulating block, said contacts being secured in the insulating block, the improvement comprising, connecting tongues formed on the metal shell, and connecting pieces provided on the grounding elements and formed with slits, each of the connecting tongues being inserted into the slit of one of the grounding elements and connected thereto, and said insulating block being formed with through-apertures with clearances for said connecting tongues and said connecting pieces of the grounding elements when said connecting tongues and connecting pieces are inserted into the through-apertures of the insulating block, thereby connecting the metal shell and the grounding elements by the connection between the connecting tongues and the connecting pieces inserted in the through-apertures of the insulating block.

2. An electrical connector as set forth in claim 1, wherein a portion of each of the connecting tongues to be inserted into the slit of each of the grounding elements is a corrugated portion.

3. An electrical connector as set forth in claim 2, wherein a side of the slit of each grounding element is formed with at least one recess in which one crest of the corrugated portion of one of the connecting tongues is fitted.

4. An electrical connector as set forth in claim 1, wherein sides of the slit of each of the connecting pieces are alternately formed with recesses and protrusions to form an undulate slit.

5. An electrical connector as set forth in claim 1, wherein a width of a bottom of each connecting piece is slightly larger than a width of the respective through-aperture of the insulating block on a side where each connecting piece is inserted in its respective through-aperture, thereby press-fitting each connecting piece into the through-aperture with a slight force.

6. An electrical connector as set forth in claim 1, wherein each of said through-apertures of the insulating block is a cross-shaped aperture in cross-section consisting of an aperture for receiving the connecting piece of each grounding element and an aperture for receiving the connecting tongue of the metal shell.

7. An electrical connector as set forth in claim 1, wherein said metal shell includes locking arms for preventing dislodgment between the connector and a mating connector, said connecting tongues being formed by partially slitting the locking arms and raising the slit portions.

8. An electrical connector as set forth in claim 1, wherein said metal shell is formed with tabs which are bent onto side edges of the insulating block, thereby assisting in firmly fixing the metal shell to the insulating block.

9. An electrical connector as set forth in claim 1, wherein said insulating block is formed with notches and said metal shell is formed with tabs corresponding to the notches of the insulating block, said tabs being fitted in the notches of the insulating block and bent along the block, thereby assisting in firmly fixing the metal shell to the insulating block.

* * * * *

UNITED STATES PATENT AND TRADEMARK OFFICE

CERTIFICATE OF CORRECTION

PATENT NO. : 4,968,261

DATED : November 6, 1990

INVENTOR(S) : Yasuyuki Mizunuma

It is certified that error appears in the above-identified patent and that said Letters Patent is hereby corrected as shown below:

Column 3, line 4, after "that" delete the comma (,);

Column 4, line 24, after "insulating" insert --block 3 so that the connecting tongues 10 enter the--.

Signed and Sealed this

Sixteenth Day of June, 1992

*Attest:*

DOUGLAS B. COMER

*Attesting Officer*

*Acting Commissioner of Patents and Trademarks*